US005328790A

United States Patent [19]

Asano et al.

[11] Patent Number: 5,328,790

[45] Date of Patent: Jul. 12, 1994

[54] PHOTORECEPTOR FOR USE IN CONTACT CHARGING METHOD AND IMAGE FORMING APPARATUS EMPLOYING SAID PHOTORECEPTOR

[75] Inventors: Masaki Asano, Amagasaki; Shuji Iino, Hirakata; Akihito Ikegawa, Sakai; Izumi Osawa, Ikeda, all of Japan

[73] Assignee: Minolta Camera Kabushiki Kaisha, Osaka, Japan

[21] Appl. No.: 949,433

[22] Filed: Sep. 23, 1992

[30] Foreign Application Priority Data

Sep. 25, 1991 [JP] Japan ..... 3-243893

[51] Int. Cl.[5] ..... G03G 15/04

[52] U.S. Cl. ..... 430/65; 430/66; 430/67

[58] Field of Search ..... 430/65, 66, 67

[56] References Cited

U.S. PATENT DOCUMENTS 4,770,964 9/1988 Fender ..... 430/65

4,904,556 2/1990 Amada et al. ..... 430/65

FOREIGN PATENT DOCUMENTS 61-148468 7/1986 Japan .

2-67575 3/1990 Japan .

*Primary Examiner*—Steve Rosasco

*Attorney, Agent, or Firm*—Willian Brinks Hofer Gilson & Lione

[57] ABSTRACT

A photoreceptor for contact charging to be used in an electrophotographic process, which includes an electrically conductive base and a photosensitive layer formed on the base so as to be charged by contact charging, and is characterized in that even when pin holes or photosensitive layer lacking portions in the form of pin holes are present on he photosensitive layer, short-circuiting is safely and positively prevented over a long period. The electrically conductive base further includes a base main body of aluminum alloy having Brinell hardness higher than 40 $H_B$, and an alumite treatment applied over the surface of the aluminum alloy base main body.

7 Claims, 4 Drawing Sheets

PHOTORECEPTOR FOR USE IN CONTACT CHARGING METHOD AND IMAGE FORMING APPARATUS EMPLOYING SAID PHOTORECEPTOR

BACKGROUND OF THE INVENTION

The present invention generally relates to a photosensitive member or photoreceptor for use in an image forming apparatus of an electrophotographic system such as a copying machine, a printer, etc., and more particularly, to a photoreceptor to be electrically charged through contact by a contact type charging device and an image forming apparatus employing such photoreceptor.

Commonly, in an electrophotographic process, for example, in a copying machine, printer or the like, it has been a normal practice to electrically charge the surface of a photoreceptor which is an electrostatic latent image holding member, by a charging device, and the charged region is subjected to exposure to image light to form an electrostatic latent image thereon, which is then developed into a visible image to be transferred onto a transfer material such as a copy paper sheet or the like.

As the charging device as referred to above, besides the non-contact type charging devices represented by corona charging devices such as corotron, scorotron chargers, etc., there have been known contact type charging devices which effect charging by causing charging members to directly contact the photoreceptor surface as in brush charging devices of stationary or rotary type, and charging devices employing charging rollers. Among these charging devices, attention has been directed to the contact type charging device, since it is very small in the deterioration on the photoreceptor surface or in the generation of ozone which affect adversely to human bodies as compared with the corona charging device.

During the manufacturing process of the electrophotographic photoreceptor, pin holes or pin hole-shaped flaws or layer lacking portions are often generated in the photosensitive layer thereof. Spray coating method, dipping coating method, and blade coating method have been commonly used to form an organic photoconductor (OPC). In these methods, photosensitive liquid is obtained by dispersing or dissolving photosensitive substance such as charge-generating substance and charge-transporting substance in a binder resin. According to spray coating method, the photosensitive liquid is sprayed onto a base member such as an aluminum drum or a resin film. According to dipping coating method, the aluminum drum or the resin film is dipped in the photosensitive liquid. According to the blade coating method, the liquid is painted on the aluminum drum or the resin film with a doctor blade. The problem of these methods is that bubbles which are formed in the liquid and may cause the generation of pin holes are liable to be formed in the photoconductor. In addition, since the organic photoconductor manufactured by these methods includes a comparatively soft binder resin as its main composition, the photoreceptor is liable to be damaged in replacing the photoreceptor or in removing jammed copy paper from a printer or a copying apparatus by a user or servicing personnel, and such damaged portion may form a pin hole or photosensitive layer lacking portion.

In charging the photoreceptor by the non-contact type charger, a short circuit rarely occurs between the base portion of the photoreceptor and the charging member even in the presence of such photosensitive layer lacking portion. But when the photoreceptor is charged by the contact type charger, the charging member to which a high voltage is applied contacts the surface of the photoreceptor, with the result that a short circuit occurs between the charging member and the base portion of the photoreceptor through the defective portion of the photosensitive layer. Such a short circuit is liable to be generated particularly by a brush charger. The occurrence of the short circuit causes the charging member or a high voltage-applying power source to be damaged and in addition, the entire surface of the photoreceptor in contact with the charging member to be uncharged because the charging member has the ground electric potential. As a result, a black stripe-like image noise is generated in reversal development, while a white stripe-like image noise is produced in normal development.

The following proposals have been made to solve the above-described problem caused by the short circuit: The proposal disclosed, for example, in Japanese Patent Laid-Open Publication Tokkaisho No. 61-148468 is such that a thin film insulating layer having a volume resistivity larger than $10^{12}\ \Omega$ cm is formed on a conductive base portion of the photoreceptor, and thereafter, a photosensitive layer is formed on said insulating layer. Another proposal described in Japanese Patent Laid-Open Publication Tokkaihei No. 2-67575 is such that a barrier layer is provided between the base portion of the photoreceptor and the photosensitive layer.

The researches made by the present inventors have revealed that even though the insulating thin film or the barrier layer is formed between the base portion of the photoreceptor and the photosensitive layer, the charging member, for example, the charging brush in particular may be brought into contact with the insulating thin film or the barrier layer through a defective portion such as a pin hole of the photosensitive layer. Therefore, the insulating thin film or the barrier layer is destroyed because the soft base portion of the photoreceptor is incapable of supporting them, and consequently, a short circuit takes place after all.

SUMMARY OF THE INVENTION

Accordingly, an essential object of the present invention is to provide a photoreceptor for contact charging to be used in an electrophotographic process, which includes an electrically conductive base and a photosensitive layer formed on said base so as to be charged by contact charging, and is characterized in that even when pin holes or photosensitive layer lacking portions in the form of pin holes are present on said photosensitive layer, short-circuiting is safely and positively prevented over a long period.

Another object of the present invention to provide a photoreceptor of the above described type capable of effectively preventing the generation of a short circuit when a contact type charger is applied to an organic photoreceptor (photoconductor) in which a pin hole is liable to be formed.

In order to solve the problems as described above, after repeated investigations made into the matter, the present inventors have found that when a photoreceptor base is prepared by a material having a hardness higher than a certain value, with an insulative thin film being formed on its surface, and a photosensitive layer formed thereon, even if the charging member should contact the insulative film through said photosensitive layer lacking portions, such thin film sufficiently supported by the base main body having the hardness is not easily damaged, and therefore, the short-circuiting may be prevented safely and positively over a long period.

Thus, according to one preferred embodiment of the present invention, there is provided a photoreceptor, charged by a contact type charger, comprising the photosensitive layer formed on the conductive base portion having Brinell hardness higher than 40 $H_B$ and the insulating layer for preventing the generation of a short circuit formed on the surface of the main body of the base portion.

More specifically, aluminum is preferably used as the material of the main body of the base portion of the photoreceptor. Aluminum alloys and the Brinell hardness thereof are exemplified below.

The standard of the aluminum alloys is based on "Encyclopedia of Aluminum" published by Light Metal Communication Co., Ltd. Japan on Nov. 1, 1969. The definition of Brinell hardness is based on a book "Hardness-testing method and its application" published by Shokabo Co., Ltd. Japan on Oct. 10, 1971. More specifically, there are employed the Brinell hardness as defined on page 7 of the book, an actual testing apparatus of hydraulic type as shown in FIG. 1—1 of the book, and measuring procedures to be carried out by using the testing apparatus as described on page 12 of the book, and steel balls of JIS B 1501 as described on page 9 of the book.

alloy (1): alloy of Al-Mn group [Mn: 1.2%] indicated by JIS mark 3003 processed only for work-hardening in a medium degree. Hardness: 40 $H_B$.

alloy (2): alloy of pure aluminum group [Al: greater than 99.0%] represented by JIS mark 1100 and sufficiently processed only for work-hardening in a sufficient degree. Hardness: 44 $H_B$.

alloy (3): alloy of Al-Mn group [Mn: 1.2%, Mg: 1.0%] indicated by JIS mark 3004 was work-hardened and then stabilizing treatment was carried out to a small degree. Hardness: 52 $H_B$.

alloy (4): alloy of Al-Mn group [Mn: 1.2%] indicated by JIS mark 3003, processed only for work-hardening in a sufficient degree. Hardness: 55 $H_B$.

alloy (5): alloy of Al-Mn-Si group [Mg: 0.7%, Si: 0.4%] indicated by JIS mark 6063 was tempered by utilizing hardening effect obtained when the alloy was cooled during manufacture. Hardness: 60 $H_B$.

alloy (6 ): alloy of Al-Mn group [Mn: 1.2%, Mg: 1.0% ] indicated by JIS mark 3004 was work-hardened and then stabilizing treatment was carried out to a comparatively high degree. Hardness: 70 $H_B$.

alloy (7): alloy of Al-Mg-Si group [Mg: 1.0%, Si: 0.6%, Cr: 0.2%, Cu: 0.25%] indicated by JIS mark 6061 was hardened and then tempered. Hardness: 95 $H_B$.

The load P=500 Kg, the diameter D=10 mm of a pressure-applying steel ball, and the load-applying time T=30 seconds are standard values in measuring Brinell hardness ($H_B$) of aluminum and an aluminum alloy used as the material of the main body of the base portion of the photoreceptor.

Alumite treatment is preferable for insulating the surface of the main body of the base portion of the photoreceptor made of an aluminum alloy. As alumite treatments, there are considered various processing using sulfuric acid and oxalic acid, etc. In alumite treatment to be carried out by using sulfuric acid, for example, sulfuric acid alumite and sulfuric acid AC treatment are utilized. In alumite treatment to be carried out by using oxalic acid, so called alumite treatment and AC alumite treatment may be raised.

The thickness of the alumite layer (insulating thin film) formed by alumite treatment is selected so that charge is not prevented from flowing therethrough and the generation of a short circuit is prevented when the image of the original document is exposed on the surface of the photoreceptor. Preferably, the thickness of the alumite layer is in the range from 3 μm to 15 μm.

As the charging devices for applying contact charging onto the photoreceptor of the present invention, there may be considered an arrangement which employs a charging brush of a stationary or rotary type for the charging member or that which uses a charging roller, charging blade, or charging film, etc. therefor, among which, the photoreceptor according to the present invention is particularly effective for the brush charging device in which short-circuiting is liable to take place if the photosensitive layer lacking portions are present.

It should be noted here that the brush fiber material for the brush charging device by which the photoreceptor of the present invention can display the short-circuit preventing function as its object, may be one which has suitable electrical resistance, flexibility, hardness, configuration and strength so that a desired charge amount can be obtained through impression of A.C. voltage, D.C. voltage or voltage resulting from superposition of the both voltages, while taking into account, positional relation with respect to other elements, system speed, etc., besides charging capacity, surface hardness, dimensions such as diameters, etc., and thus, there is no particular limitation from the viewpoint of materials.

For the electrically conductive materials, metallic wires of tungsten, stainless steel, gold, platinum, aluminum, iron, copper, etc. may be employed by properly adjusting length or diameter thereof.

As the electrically conductive resin materials, there may be employed those in which resistance adjusting agents such as carbon black, carbon fibers, metallic powder, metallic whiskers, metallic oxides, semiconductors, etc. are dispersed in fibers such as rayon, nylon, acetate, copper ammonium, vinylidene, vinylon, fluoroethylene, promix, benzoate, polyurethane, polyester, polyethylene, polyvinyl chloride, polychlal, polynosic, polypropylene, etc. In the above case, by the amount of dispersion, desired resistance values may be suitably obtained. Similarly, the resistance adjusting material may be applied over the fiber surface instead of dispersion thereof in the fiber.

The electrical resistivity of such fiber material is normally set to be generally below $10^9$ Ω cm, and preferably, be below $10^7$ Ω cm in a volume resistivity in order to obtain a favorable charging performance.

The sectional configuration of the fiber may be circular, elliptic, circular with corrugation along the circumference, polygonal or flat so long as the charge performance thereof is not deteriorated.

According to the photoreceptor of the present invention, the surface thereof is charged by the charger and the image of an original document is exposed on the charging region of the surface thereof to form an electrostatic latent image thereon, and then, the electrostatic latent image is developed into a visible image by a developing device, similarly to a conventional photoreceptor.

According to the photoreceptor of the present invention, the insulating layer made of a thin film (alumite layer) is formed on the surface of the main body of the base portion thereof. Therefore, even though the charging member is brought into contact with the insulating layer (alumite layer) through a defective portion of the photosensitive layer thereof, the generation of a short circuit can be prevented. In addition, the insulating layer (alumite layer) is supported by the main body of the base portion made of aluminum alloy having Brinell hardness more than 40 $H_B$, the insulating layer (alumite layer) can be prevented for a long time from being destroyed even though the insulating layer (alumite layer) contacts the charging member due to the destruction of the thin film of the insulating layer. Thus, the main body of the base portion of the photoreceptor is not exposed and hence, a short circuit is not generated.

It should be note here that the present invention is not limited in its application to an aluminum base plate and alumite treatment alone, but may be readily applied to conductive base plates and insulating treatments in general.

BRIEF DESCRIPTION OF THE DRAWINGS

These and other object and features of the present invention will become clear from the following description taken in conjunction with the preferred embodiments thereof with reference to the accompanying drawings, in which.

DETAILED DESCRIPTION OF THE PREFERRED EMBODIMENTS

Figure 1:
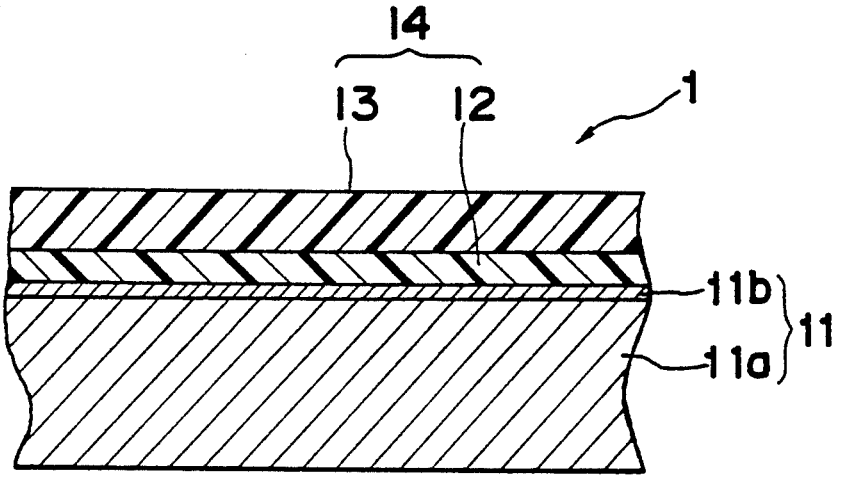
FIG. 1 is a sectional view showing the construction of a photoreceptor according to one embodiment of the present invention.

Before the description of the present invention proceeds, it is to be noted that like parts are designated by like reference numerals throughout the accompanying drawings.

One embodiment of the present invention is described below with reference to FIGS. 1 through 5. FIG. 1 shows the construction of an electrophotographic photoreceptor common to each embodiment of the present invention.

As shown in FIG. 1, a photoreceptor drum 1 of the embodiment comprises a cylindrical base portion 11; and a photosensitive layer 14 composed of a charge-generating layer 12 disposed on the surface of the photoreceptor drum 1 and a charge-transporting layer 13 disposed on the charge-generating layer 12. The photoreceptor drum 1, made of an organic material which is negatively charged, is of a function-separated type and has a favorable sensitivity to light with a long wavelength such as semiconductor laser beams (780 nm) or LED beams (680 nm).

The base portion 11 further includes a main body 11*a* composed of aluminum alloy having Brinell hardness higher than 40 $H_B$, and an insulating layer (alumite layer) 11*b* disposed on the main body 11*a*. The method for manufacturing the insulating layer (alumite layer) 11*b* is described later. The photosensitive layer 14 is formed as follows: First, 1 part by weight of $\tau$-type non-metal phthalocyanine, 2 parts by weight of polyvinyl butyral resin (acetylation degree: less than three mole %, butylation degree: 70 mole %, polymerization degree: 1,000) serving as a binder resin, and 100 parts by weight of tetrahydrofuran were put into a ball mill pot and left for 24 hours for dispersion. As a result, photosensitive liquid (viscosity: 15 cp at 20° C.) having phthalocyanine dispersed in the binder resin was obtained. The liquid was applied to the cylindrical base portion 11 which was 30 mm in outer diameter, 240 mm in length, and 0.8 mm in thickness by means of dipping method. Then, the liquid was dried in circulating air at 20° C. for 30 minutes to form a charge-generating layer of 0.4 $\mu$m in thickness.

It should be noted here that in the present embodiment, although the thickness of the base portion 11 (sustantially the thickness of the alloys 1 to 7) was set to be 0.8 mm, with the base portin 11 being formed in the drum shape, the configuration of the base portion is not limited to such drum shape, but it may be so arranged to apply an insulating treatment (alumite treatment) to a very thin resin or metallic film. It is essential that the hardness (Brinell harness) of the surface of the main body 11*a* in contact with the insulated layer (insulating alumite layer) 11*b* is included in the claim of the present invention.

Preferably, the base portion 11 should be in the range from 0.2 mm to 5 mm in its thickness, and has Brinell hardness as defined in the claim of the present invention in view of machining accuracy and cost, when the above embodiment is formed by the aluminum base member.

Subsequently, onto said charge generating layer, a coating solution (viscosity 240 cp at 20° C. prepared by dissolving 8 weight parts of hydrazone compound represented by a structural formula,

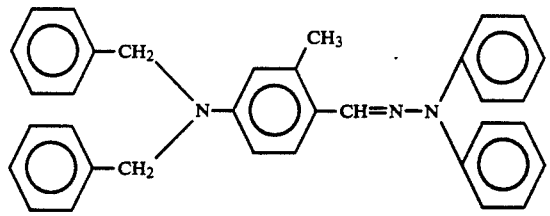

0.1 weight part of orange pigment (Sumiplast Orange 12; name used in trade and manufactured by Sumitomo Chemical Co., Ltd. Japan), and 10 weight parts of polycarbonate resin (Panlight L-1250; name used in trade and manufactured by Teijin Kasei Co., Ltd. Japan) as a binder resin, into a solvent composed of 180 weight parts of tetrahydrofuran, was applied through employment of the dipping method, and then, dried for 30 min. in a circulating air at 100° C. to form the charge transport layer 13 with a film thickness of 28 $\mu$m, and thus, the photoreceptor 1 was prepared.

When X-ray of CuK$\alpha$/Ni having a wavelength of 1.541 Å is used, $\tau$-type non-metal phthalocyanine has a diffraction pattern showing a strong peak at Bragg angle of ($2\theta \pm 0.2$ degree) 7.6, 9.2, 16.8, 17.4, 20.4, and 20.9. Particularly, phthalocyanine has four strongest absorption bands at $751 \pm 2$ $cm^{-1}$ between 700 and 760 $cm^{-1}$ in infrared absorption spectrum, two absorption bands generally having the same strength between 1320 to 1340 $cm^{-1}$ in infrared absorption spectrum, and characteristic absorption at $3288 \pm 3$ $cm^{-1}$.

The photoreceptor of the embodiment sensitive to light with a long wavelength as a described above may be used in an image forming system such as a semiconductor laser optical system or an LED array which uses light having a long wavelength. The photoreceptor to which the present invention may be applied is not limited to the photoreceptor as described so far, but may be appropriately selected according to the kind of an optical system. For example, a photoreceptor having a sensitivity in a relative spectral region may be used in an image forming system which includes liquid crystal shutter array or PLZT shutter array, and uses visible light as a light source or an analog image forming system based on visible light and a lens/mirror optical system, widely used by general copying apparatuses. The photoreceptor 1 of the embodiment is of the function separate type organic photoreceptor, provided with the charge-generating layer and the charge-transporting layer formed thereon, but photoreceptors of the present invention is not limited to such function separate type.

That is, the charge-generating layer may be formed over the charge transporting layer or may be a single layer having both charge-generating function and charge-transporting function. The charge-generating material, the charge-transporting material, and the binder resin may be properly selected from known materials depending on purposes.

In addition, inorganic materials such as zinc oxide, cadmium sulfide, alloys of selenium group, alloys of amorphous silicon group may be used as the material therefor.

The photoreceptor of the present invention may be provided with a surface-protecting layer in order to improve the durability, resistance against environmental conditions, etc. thereof, and an under-layer in order to improve charge performance, image quality, and adhesion property, etc.

The following materials can be used as the material of the surface protecting layer and the under-layer as referred to above. Resin which is hardened by ultraviolet ray; room temperature setting resin; thermosetting resin; resin in which resistance-regulating material is dispersed in the above resins; metallic oxide and metallic sulfide made into thin films by vapor deposition or ion plating method; indefinite shape carbon film and indefinite shape silicon carbide film manufactured by plasma polymerization.

The base portion of the photoreceptor may be flat or belt-shaped besides the cylindrical shape.

The method for forming the insulating layer (alumite layer) 11*b* is specifically described below. In the following embodiments 1 through 7, the insulating layer 11*b* was manufactured by specifying the quality of the material of the main body 11*a* of the base portion 11 and the method for treating the surface of the main body 11*a* with alumite (anodic oxidation). The alloys (1) through (7) are those which have been already described previously in SUMMARY OF THE INVENTION. "$\alpha$ method" and "$\beta$ method" in the alumite treatment are described below. In each of the embodiments, it was adjusted and processed so that the alumite layer was formed in the thickness of 6 $\mu$m. In comparison examples 1 through 4, the method for forming the alumite layer is similar to that of the embodiments except the material of the main body 11*a*.

$\alpha$ method: alumite sulfate method in the following condition electrolytic bath: $H_2SO_4$ 10 to 20%
current density ($A/dm^2$): D.C. 0.6 to 2
voltage (V): 10 to 25
temperature (°C.): 15 to 25
time (minute): 20 to 60

Alumite treatment was carried out in the above condition and then, water-sealing treatment was performed by using water vapor.

$\beta$ method: alumite method in the following condition electrolytic bath: $(COOH)_2$ 2 to 4%
current density ($A/dm^2$): A.C. 1
voltage (V): A.C. 80 to 120
temperature (°C.): 20 to 29
time (minute): 20 to 60

Alumite treatment was carried out in the above condition and then, water-sealing treatment was performed by using water vapor.

The materials of the main body 11*a* used in the following comparison examples 1 through 4 are as follows:

alloy A: not hardened by work hardening, hardening or tempering, with alloy of pure aluminum group [Al: greater than 99.6%] indicated by JIS mark 1060 being fully annealed. Hardness: 19 $H_B$.

alloy B: not hardened by work hardening, hardening or tempering, with alloy of Al-Mg-Si group [Mg: 0.7%, Si: 0.4%] indicated by JIS mark 6063 being fully annealed. Hardness: 25 $H_B$.

alloy C: not hardened by work hardening, hardening or tempering, with alloy of Al-Mg-Si group [Mg: 1.0%, Si: 0.6%, Cr: 0.2% Cu: 0.25%] indicated by JIS mark 6061 being fully annealed. Hardness: 30 $H_B$.

alloy D: only work hardening was carried out to a slight extent, with alloy of Al-Mn group [Mn: 1.2%] indicated by JIS mark 3003. Hardness: 35 $H_B$.

| | main body material | hardness ($H_B$) | alumite treatment | |
|---|---|---|---|---|
| E1 | alloy (1) | 40 | $\alpha$ method (E 1a) | $\beta$ method (E 1b) |
| E2 | alloy (2) | 44 | $\alpha$ method (E 2a) | $\beta$ method (E 2b) |
| E3 | alloy (3) | 52 | $\alpha$ method (E 3a) | $\beta$ method (E 3b) |
| E4 | alloy (4) | 55 | $\alpha$ method (E 4a) | $\beta$ method (E 4b) |
| E5 | alloy (5) | 60 | $\alpha$ method (E 5a) | $\beta$ method (E 5b) |
| E6 | alloy (6) | 70 | $\alpha$ method (E 6a) | $\beta$ method (E 6b) |
| E7 | alloy (7) | 95 | $\alpha$ method (E 7a) | $\beta$ method (E 7b) |
| C1 | alloy A | 19 | $\alpha$ method (C 1a) | $\beta$ method (C 1b) |
| C2 | alloy B | 25 | $\alpha$ method (C 2a) | $\beta$ method (C 2b) |
| C3 | alloy C | 30 | $\alpha$ method (C 3a) | $\beta$ method (C 3b) |
| C4 | alloy D | 35 | $\alpha$ method (C 4a) | $\beta$ method (C 4b) |

Remarks:
In the above, E denotes embodiment and C indicates comparison example.

Figure 2:
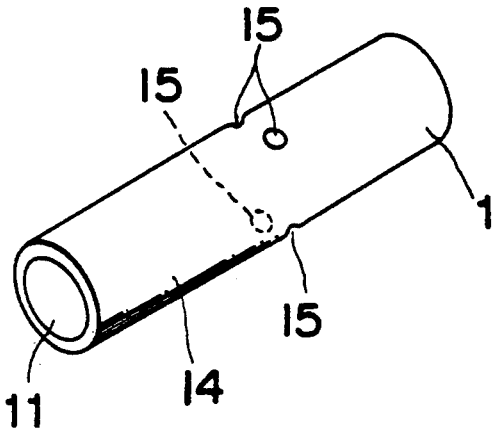
FIG. 2 is a view for describing the state in which pin holes are formed on a photoreceptor in order to examine the short circuit state of the photoreceptor.

In each of the embodiments 1 through 7 and the comparison examples 1 through 4, using THF as a solvent, four pin holes 15 were formed on the photosensitive layer 14 by dividing the circumference equally into four in the central portion of the photosensitive layer 14 in the longitudinal direction thereof as shown in FIG. 2. The diameter of each pin hole 15 was 3 mm. As a result, the alumite layer was exposed to the exterior. Photoreceptors of the embodiments 1 through 7 and the comparison examples 1 through 4 were installed on a printer as shown in FIG. 4 and subjected to contact charge to examine the short circuit state of each photoreceptor.

Figure 4:
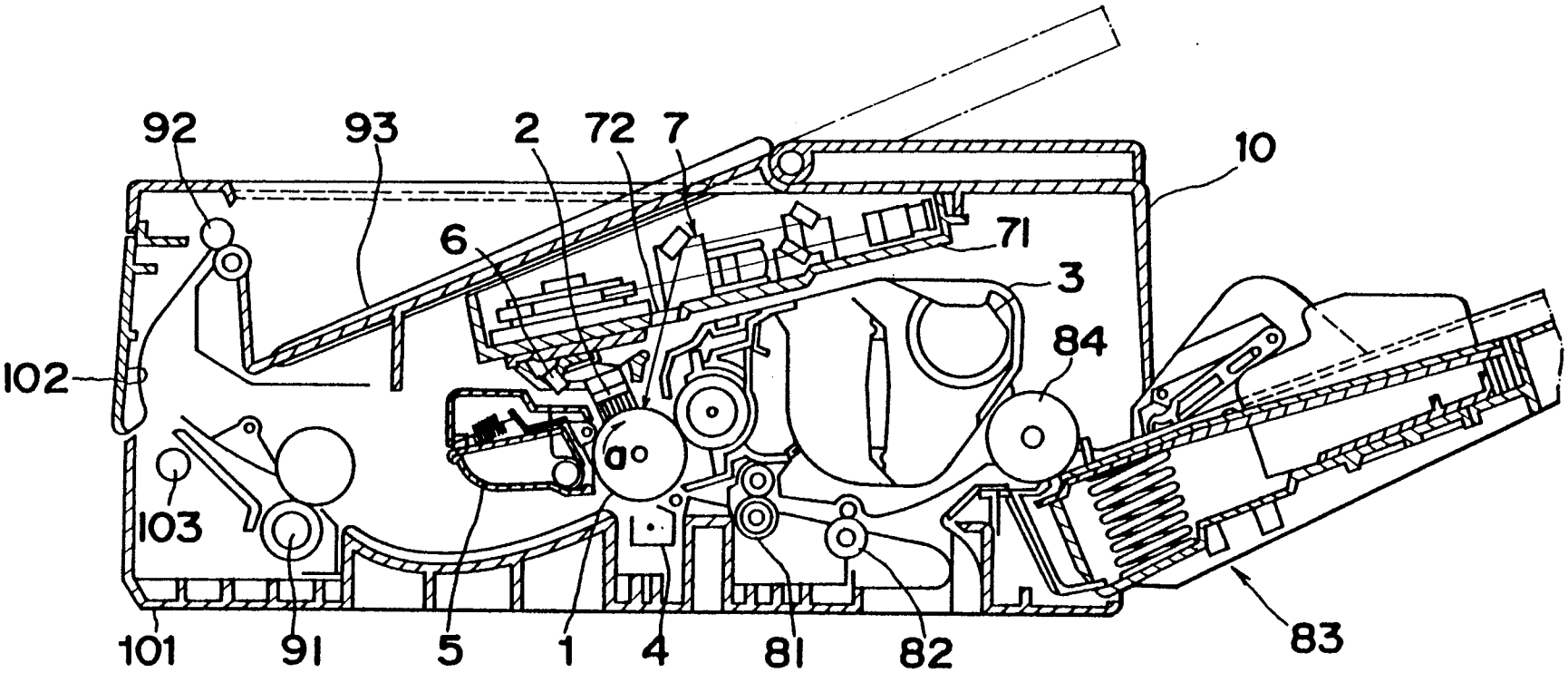
FIG. 4 is a side sectional view showing general construction of a printer employed to study the short circuit state of the photoreceptors for the embodiments and those for the comparison examples.

The printer as shown in FIG. 4 is provided with the photoreceptor drum 1 of the embodiments 1 through 7 and the comparison examples 1 through 4 at the central portion thereof. The photoreceptor drum 1 is rotated clockwise as indicated by an arrow a by a driving means (not shown) at a peripheral speed of 35 mm/sec. A fixed type brush charger 2, a developing device 3, a transfer charger 4, a cleaning device 5, and an eraser 6 are sequentially disposed around the periphery of the photoreceptor drum 1.

An optical system 7 accommodated in a housing 71 is disposed above the photoreceptor drum 1. The optical system 7 comprises a semiconductor laser generating device, a polygon mirror, a toroidal lens, a half mirror, a spherical mirror, a return mirror, and a reflecting mirror, although not particularly indicated. An exposure slit 72 is formed on the lower surface of the housing 71 so that the image of an original document is exposed to the photoreceptor drum 1 through the charging device 2 and the developing device 3.

At the right of the photoreceptor drum 1 of FIG. 4, a set of timing rollers 81, a set of intermediate rollers 82, and a paper supply cassette 83 are sequentially disposed. A paper supply roller 84 is disposed adjacently to the paper supply cassette 83. At the left of the photoreceptor drum 1 of FIG. 4, a set of fixing rollers 91 and a set of paper discharge rollers 92 are disposed. A paper discharge tray 93 is disposed adjacently to the paper discharge rollers 92.

The main body 10 of the printer accommodates all of the above-described components. The main body 10 comprises a lower unit 101 and an upper unit 102. The upper unit 102 accommodates the charger 2, the developing device 3, the cleaning device 5, the eraser 6, the optical system 7, the upper roller of the set of the timing rollers 81, the upper roller of the set of the intermediate roller 82, the paper supply roller 84, the upper roller of the set of the fixing rollers 91, the paper discharge roller 92, and the paper discharge tray 93. The upper unit 102 is pivotable about a shaft 103, i.e., the end portion of the paper supply side can be opened to remove jammed paper from the printer and perform maintenance and repair work.

Figure 5A:
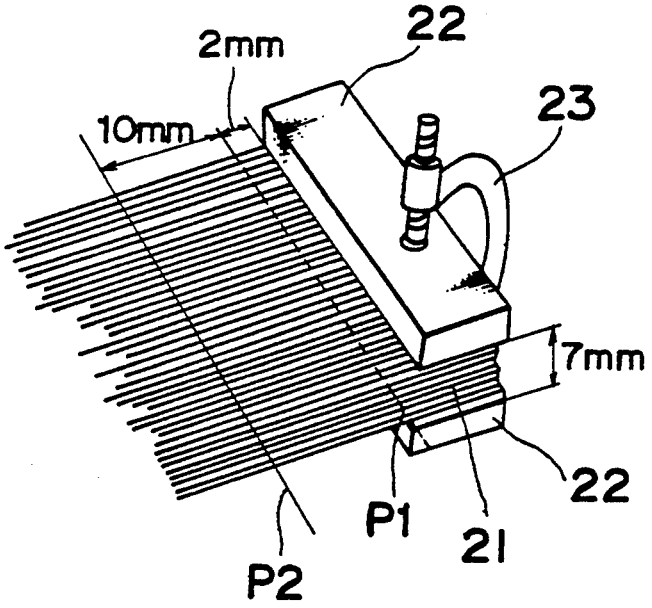
FIGS. 5(A) and 5(B) are perspective views for describing a brush charger of the printer in FIG. 4.
Figure 5B:
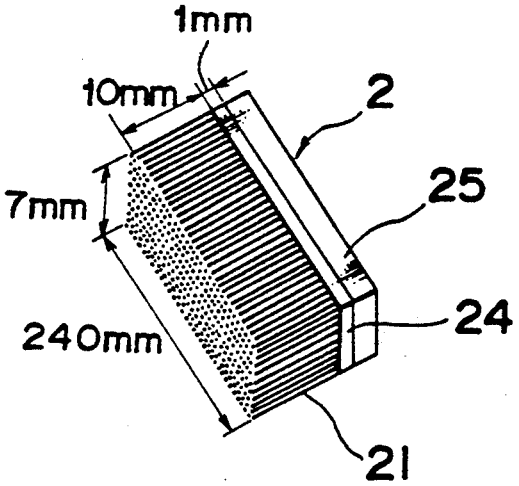

The fixed type brush charger 2 is shown in FIGS. 5(A) and 5(B). That is, as shown in FIG. (5)A, a plurality of tungsten wires 21 (diameter: 50 μm) arranged in the same direction are sandwiched between a pair of sandwiching members 22 having the same length of 240 mm as that of the photoreceptor drum 1 in the longitudinal direction so that the thickness of the bundled tungsten wires 21 uniformly becomes 7 mm. Epoxy resin was poured into the spaces between the tungsten wires 21 in the range from a position shown by P1 which is 2 mm distant from the left edge of the sandwiching members 22 to the right edge thereof. Then, the sandwiching members 22 were strongly clamped together by a vise 23. After epoxy resin was hardened, the tungsten wires 21 were cut off at a position spaced from the members 22 by 12 mm, i.e. at a position shown by P2 which is 10 mm distant from the position P1. Thereafter, the tungsten wires 21 were also cut off at a position which is 1 mm distant from the left edge of the sandwiching members 22. Then, the cut-off portion 24 of the tungsten wires 21 solidified by the epoxy resin was removed from the vise 23 so as to fix it to a base plate 25 made of aluminum with a conductive adhesive tape, both surfaces of which are adhesive.

The brush of the charger 2 was brought into contact with the surface of the photosensitive drum 1 by pressing the brush in a length of 1 mm against the surface of the photoreceptor drum 1. A voltage of −1.2 KV was applied to the charger 2 by a power source to charge the surface of the photoreceptor drum 1 at approximately −800 V. The maximum current capacity of the −1.2 KV power source was 100 μA.

Mono-component developer mainly including toner of a negatively charging type was used by the developing device 3. The toner was manufactured in such a manner that a compound consisting of 100 parts by weight of polyester resin of bisphenol A type, 5 parts by weight of carbon black MA#8 (name used in trade and manufactured by Mitsubishi Chemical Industries, Ltd. Japan), 3 parts by weight of Bontron S-34 (name used in trade and manufactured by Orient Chemical Industries, Ltd. Japan), and 2.5 parts by weight of Viscol TS-200 (name used in trade and manufactured by Sanyo Chemical Industries, Ltd. Japan) was kneaded, ground, and classified by a known method. As a result, toner particles having an average particle diameter of 10 μm were obtained. The diameters of 80 wt % of toner particles thus prepared were in the range from 7 to 13 μm. As a fluidizing agent, 0.75 wt % of hydrophobic silica Tanolux 500 (name used in the trade and manufactured by Talconen Co., Ltd.) was added to toner particles and then, a mixture was mixed and stirred by a homogenizer.

The black toner, of negatively-charged type, which was intransparent and non-magnetic was accommodated in the developing device 3 and a reversal development was carried out under the application of a developing bias at −250 V.

The developer and the developing method applicable to the photoreceptor according to the present invention are not limited to the above-described developer and the developing method. It is possible to select toner and a developing method appropriately from toner of positively-charged type, transparent toner, magnetic toner, or dual-component developing method, and normal developing method. Not only black toner, but also color toner such as yellow toner, magenta toner or cyan toner may be appropriately employed. Toner may be of an indefinite shape or of a specific shape e.g., spherical shape. Lubricant such as polyvinylidene fluoride or the like may be added to toner in order to improve cleaning performance.

According to the printer shown in FIG. 4, the surface of the photoreceptor drum 1 is charged by the brush charger 2 at a predetermined electric potential and the optical system 7 exposes the image of the original document in the charging region of the surface of photoreceptor drum 1 to form an electrostatic latent image thereon. The electrostatic latent image thus formed is developed into a toner image by the developing device 3 and the toner image arrives at the transfer region confronting the transfer charger 4.

Meanwhile, copy paper is drawn out from the paper supply cassette 83 by the paper supply roller 84 and then, arrives at the set of the timing rollers 81 through the set of the intermediate rollers 82. Then, the copy paper is transported into the transfer region in synchronization with the toner image disposed on the photoreceptor drum 1. In this manner, the toner image is transferred onto the copy paper by the action of the transfer charger 4. Then, the copy paper is fed to the set of the fixing rollers 91 at which the toner image is fixed to the copy paper. Thereafter, the copy paper is discharged onto the paper discharge tray 93 by the set of the paper discharge rollers 92.

After the toner image is transferred to the copy paper, toner which has remained on the photoreceptor drum 1 is cleaned by the cleaning device 5 and residual charge is erased by the eraser 6.

Figure 3:
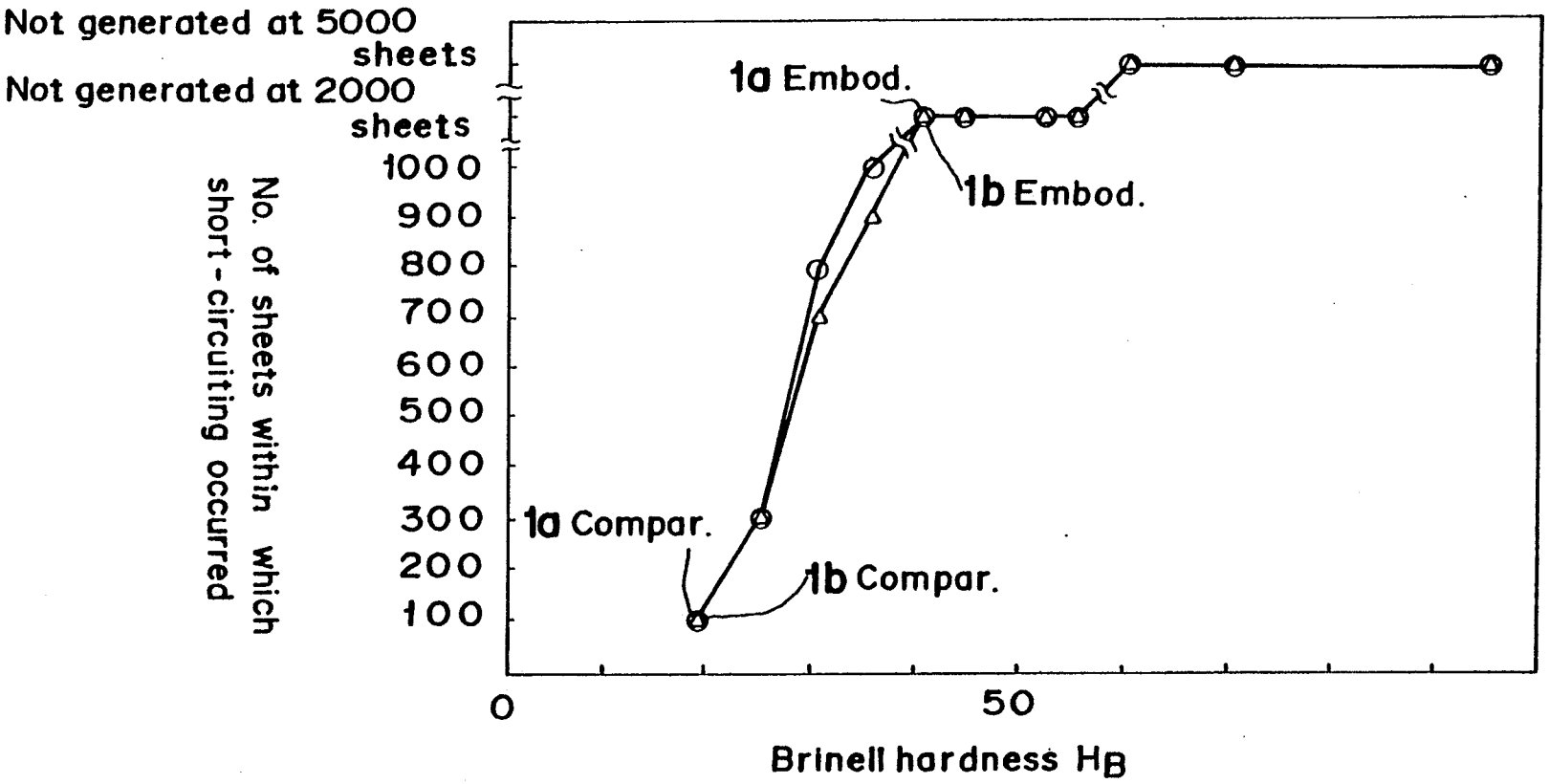
FIG. 3 is a graph showing the results of tests for examining the short circuit state of the photoreceptors for embodiments and those for comparison examples.

FIG. 3 shows the result of the tests conducted to examine the short circuit state of the photoreceptor drum 1 of the embodiments 1 through 7 and the comparison examples 1 through 4. As shown in FIG. 3, the short circuit did not occur in any photoreceptor drums 1 when copying operation was carried out for the first copy paper, but in some photoreceptor drums 1 having pin holes, image noises were observed in the form of black-stripe lines along the longitudinal direction of the photoreceptor drums 1.

The graph of FIG. 3 shows the relationship between the number of sheets (every 100 sheets) and the hardness of the main body 11*a* of the base portion 11 of the photoreceptor drum 1. The mark 0 shows the test result of the photoreceptor drum 1 which was alumite-treated by $\alpha$ method on the surface of the main body 11*a* and the mark $\Delta$ shows the test result of the photoreceptor drum 1 which was alumite-treated by $\beta$ method on the surface of the main body 11*a*. For example, in the case of the drum of comparison example 1 (comparison examples 1*a* and 1*b*) having Brinell hardness at 19, a short circuit occurred both in $\alpha$ method and $\beta$ method before the image of the original document was copied on 100 copy paper sheets. As shown by the graph of FIG. 3, short circuits occurred before the image of the original document was copied on 1000 copy paper sheets in the case of the drums of comparison examples 1 through 4 having Brinell hardness smaller than 40. This may be attributable to the fact that the ground for the alumite layer was soft, and thus the alumite layer was destroyed, i.e., the alumite layer sank into the main body 11*a* of the base portion 11 of the photoreceptor drum 1. As a result, the charge brush was brought into contact with the main body 11*a* and thus, short circuits occurred.

The graph in FIG. 3 also shows that no short circuits occurred even though the image of the original document was copied on as many as 2000 copy paper sheets in the case of the drums of the embodiments 1 through 7 having Brinell hardness greater than 40 regardless of whether the alumite treatment was carried out by $\alpha$ method or by $\beta$ method.

It is to be noted here that, with respect to the above embodiments 1 to 7 and comparison examples 1 to 4, similar results may be obtained by a charging device employing a rotary type charging brush or a charging device arranged to contact the rotary type charging brush onto the photoreceptor surface by a proper urging means such as a spring or the like.

As is clear from the foregoing description, according to the present invention, there is provided the photoreceptor for contact charging to be used in an electrophotographic process, which includes the electrically conductive base and the photosensitive layer formed on said base so as to be charged by contact charging and is characterized in that even when pin holes or photosensitive layer lacking portions in the form of pin holes are present on said photosensitive layer, short-circuiting is safely and positively prevented over a long period.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A photoreceptor to be used for a charging method of contact type comprising:

a conductive substrate, made of a metal of aluminum group, the surface of which has Brinell hardness at greater than 40 $H_B$;

an alumite layer formed on the surface of said conductive substrate and having a thickness from 3 $\mu$m to 15 $\mu$m; and a photosensitive layer formed on said insulating layer.

2. A photoreceptor as defined in claim 1, wherein said photosensitive layer includes binder resin.

3. A photoreceptor as defined in claim 1, wherein the thickness of said conductive substrate is in the range of 0.2 mm to 5 mm.

4. A photoreceptor as defined in claim 1, wherein said alumite is subjected to a sealing treatment.

5. An image forming apparatus comprising:

a photoreceptor including:

a conductive substrate, the surface of which has Brinell hardness at greater than 40 $H_B$;

an insulating layer, made of alumite, formed on the surface of said conductive substrate and having a thickness of 3 $\mu$m to 15 $\mu$m; and a photosensitive layer further formed on said insulating layer; and charging means including:

a contact member which is brought into contact with said photoreceptor; and voltage-applying means for applying a voltage to said contact member so as to charge said photoreceptor; and exposing means for forming an electrostatic latent image on said photoreceptor which has been charged.

6. An image forming apparatus as defined in claim 5 wherein said photosensitive layer includes binder resin.

7. An image forming apparatus as defined in claim 5 wherein said contact member is brush-shaped.

* * * * *